US008718900B2

(12) United States Patent
Schoen

(10) Patent No.: US 8,718,900 B2
(45) Date of Patent: May 6, 2014

(54) METHOD TO OPERATE AN INTERNAL COMBUSTION ENGINE—ENGINE MANAGEMENT SYSTEM USING ADAPTIVE IGNITION AND FUEL QUANTITY OPTIMIZATION WITH MINIMAL SENSOR REQUIREMENTS FOR STANDARD AND BIO-FUELS

(76) Inventor: André Schoen, Berlin (DE)

( * ) Notice: Subject to any disclaimer, the term of this patent is extended or adjusted under 35 U.S.C. 154(b) by 1124 days.

(21) Appl. No.: 12/598,545

(22) PCT Filed: Dec. 14, 2007

(86) PCT No.: PCT/EP2007/011017
§ 371 (c)(1),
(2), (4) Date: Feb. 8, 2010

(87) PCT Pub. No.: WO2008/135075
PCT Pub. Date: Nov. 13, 2008

(65) Prior Publication Data

US 2010/0138138 A1 Jun. 3, 2010

(30) Foreign Application Priority Data

May 3, 2007 (DE) ..... 10 2007 020 764

(51) Int. Cl.
*F02P 5/15* (2006.01)
*F02P 5/145* (2006.01)

(52) U.S. Cl.
USPC ..... 701/103; 123/406.28

(58) Field of Classification Search
USPC ..... 701/103, 101, 102, 104, 105, 110, 113; 123/406.28, 406.35, 406.41, 406.53, 123/406.54, 406.58, 494; 73/114.08, 73/114.09, 114.11, 114.01
See application file for complete search history.

(56) References Cited

U.S. PATENT DOCUMENTS

| | | | | |
|---|---|---|---|---|
| 4,760,830 | A * | 8/1988 | Bullis et al. | 123/501 |
| 5,050,556 | A * | 9/1991 | Williams et al. | 123/406.28 |
| 5,103,789 | A * | 4/1992 | Hartman et al. | 123/435 |
| 5,537,978 | A | 7/1996 | Watanabe et al. | |
| 5,659,133 | A * | 8/1997 | Sims et al. | 73/114.09 |
| 2004/0103860 | A1 | 6/2004 | zur Loye et al. | |
| 2005/0072402 | A1 | 4/2005 | Zurloye et al. | |

FOREIGN PATENT DOCUMENTS

| | | |
|---|---|---|
| DE | 25 13 289 | 10/1976 |
| DE | 195 13 307 | 10/1995 |
| DE | 199 52 096 A1 | 5/2001 |
| DE | 103 07 367 | 9/2004 |
| DE | 103 30 819 | 2/2005 |

(Continued)

OTHER PUBLICATIONS

EPO Office Action for EP 07 856 755.9 dated Oct. 4, 2011.

(Continued)

*Primary Examiner* — Mahmoud Gimie
(74) *Attorney, Agent, or Firm* — RatnerPrestia

(57) ABSTRACT

A method to operate an internal combustion engine, comprising the steps of direct or indirect measurement in a cylinder and/or in a working cycle of the time or point or area/band where the combustion process of an internal combustion engine completes the ignition phase or nears the end of the ignition phase and begins or transits into the combustion phase, or which marks the beginning of the combustion phase, or otherwise marks that the combustion process has commenced.

21 Claims, 5 Drawing Sheets

(56) References Cited

FOREIGN PATENT DOCUMENTS

| | | | | |
|---|---|---|---|---|
| DE | 103 56 133 | A1 | 7/2005 | |
| DE | 697 35 846 | | 10/2006 | |
| DE | 102007052687 | A1 * | 5/2009 | ..... F02D 35/02 |
| EP | 0 358 419 | | 3/1990 | |
| EP | 0 810 362 | | 12/1997 | |
| EP | 1 164 277 | | 12/2001 | |
| EP | 1 777 398 | | 4/2007 | |
| GB | 2173925 | A | 10/1986 | |
| WO | WO 2006/053438 | | 5/2006 | |

OTHER PUBLICATIONS

Winkelhoffer et al., "Optische Verbrennungs-diagnostik mit einfach applizierbarer Sensorik," MTZ Journal, 2001, Issue 62, pp. 644-651.

Spicher et al., "3D-Lichtleitermesstechnik zur räumlichen Flammenanalyse in Verbrennungsmotoren," MTZ Journal, 2007, Issue 63, pp. 294-301.

* cited by examiner

METHOD TO OPERATE AN INTERNAL COMBUSTION ENGINE—ENGINE MANAGEMENT SYSTEM USING ADAPTIVE IGNITION AND FUEL QUANTITY OPTIMIZATION WITH MINIMAL SENSOR REQUIREMENTS FOR STANDARD AND BIO-FUELS

CROSS REFERENCE TO RELATED APPLICATIONS

This application is the U.S. national phase application of PCT International Application No. PCT/EP2007/011017, filed Dec. 14, 2007, which claims priority to German Patent Application No. DE 10 2007 020 764.8, filed May 3, 2007, the contents of such applications being incorporated by reference herein in their entirety.

BACKGROUND OF THE INVENTION

1. Technical Field

Method with minimal sensor requirements to control ignition timing for internal combustion engines or injection timing for diesel engines, as well as for optimizing fuel injection quantities.

Most ignition systems are predictive, approximating the time from ignition to combustion ("ignition time") with stored test engine parameters. By contrast, this invention uses one sensor measuring directly or indirectly the "ignition time" in real time, where the measuring can also be used for fuel quantity optimization. Therefore, fewer sensors are needed in general and in particular when fuel types are mixed (petrol, ethanol, gas or diesel and bio-fuel). Cost to produce an automotive engine management system can be reduced, while the system reliability increases. Fuel consumption is reduced, since the engine runs optimally under more combinations of external parameters (humidity, air pressure, air and engine temperature, fuel quality and mix, wear and tear, etc.).

2. Description of Related Art

This invention concerns a method to operate an internal combustion engine as well as an internal combustion engine, which operates in accordance with the method described in this invention.

When operating an internal combustion engine, it is often necessary to control the point where combustion commences. Since there is a delay between fuel ignition (firing spark plugs or injecting diesel) and start of (full) combustion, an ignition control system must start the ignition process a certain amount of time ahead of a reference point, where the amount of time depends on the time needed for the fuel to ignite.

To compute optimal timing and fuel dosage parameters, traditionally, a predictive approach is used, where in a test laboratory/test field setting; engines are subjected to different environment and load situations. Such test field results are then stored in an appropriate form, mostly electronically (ROM) or mechanically (spring). During engine operation, the stored parameters together with proxy sensors are used to predict the ignition time or the injection time. However, most of these methods try to predict or estimate parameters, which are at least to some degree, based on the environment during the laboratory trials. Wear and tear or unusual combinations of circumstances can only partially be accommodated. Also, changes in fuel mixtures (addition of bio fuels, ethanol, gas, etc) and changes in fuel quality can only be accommodated for in approximate terms.

EP 0 810 362 D2 discloses a method to estimate and control the combustion rate with discrete measurements of cylinder pressure. Combustion rate is controlled by a combination of varying fuel amounts and ignition timing. Adaptive ignition by contrast does not use cylinder pressure or estimates of combustion rates, but measures the SOC point using a continuous sensor reading. Further, adaptive ignition does not use fuel quantities to control ignition timing and more importantly, adaptive ignition controls ignition timing, not combustion rate.

EP 1 777 398 A2 discloses an invention to control a variable valve actuation system using cylinder pressure as input in an auto ignition application. Cylinder pressure is not used by adaptive ignition, nor is adaptive ignition intended for valve timing control. Further, adaptive ignition is not restricted in its application to auto ignition, as it can be used for conventional (petrol) as well as auto ignition (diesel) engines.

EP 1 164 277 A2 discloses a method to control auto ignition for pre-mixed fuel (multi injection, etc.), to some degree applying predictive (table lookup) rather than adaptive algorithms. Main variable is calculated heat release deduced from cylinder pressure. By contrast, adaptive ignition does not use cylinder pressure and is not restricted to the very specific application of auto ignition using petrol.

DE 195 13 307 AI discloses a process to determine type of fuel used (heavy or light quality), using cylinder pressure as input. Uses total time of combustion to deduce which fuel type is in use, by analyzing cylinder pressure. Adaptive ignition adapts to different fuel types, but does otherwise not try to recognize fuel types and more importantly, adaptive ignition does not use cylinder pressure.

Patent DE 103 30 819 B4 deals with a method to obtain a homogenous combustion and minimising the amount of particles by measuring light emitted at very specific wavelengths. The AI (adaptive ignition) patent has as its main purpose not the homogeneity of a combustion or particle reduction, but aims to determine the optimum time to commence firing spark plugs (petrol application) or injecting fuel (diesel application). Adaptive ignition is also not restricted to the use of optical sensors. However, when using optical sensors, it does not evaluate specific wavelengths, but the integral of all light emitted.

DE 103 07 367 A 1 deals with a method to control engines fueled with gas, where the cylinder pressure is measured and analysed. The principal aim is to control the fuel (gas) quantity, although no specific algorithm is mentioned. Further, there are unspecific provisions to influence ignition timing, based on the analysis of cylinder pressure curves. Adaptive ignition on the contrary has as its main goal a precise control of the point where spark plugs are to be fired, or diesel is to be injected. Further, adaptive ignition is not restricted to the use of gas as fuel and does not use cylinder pressure, nor does it operate by analysing pressure curves.

DE 25 13 289 AI deals only with diagnostics in a laboratory setting, not a real time method.

DE 697 35 846 T2 discloses a method which only applies to diesel engines (pressure ignition) with pre-mixed fuel in the cylinder. The ignition timing is not controlled by the injection timing of primary fuel (or firing of spark plugs) Timing of the injection of the secondary fuel is not linked to a sensor measurement, but only broadly linked to an electronic control unit. The means to control the ignition timing are also the quantity of a secondary fuel injection, as well as a variable compression ratio, rather than the timing (as in adaptive ignition) of the fuel injection (or firing of spark plugs).

WO 2006/053438 AI uses a bearing mounted accelerometer as proxy of cylinder pressure, to determine combustion quality, predominantly for premixed fuel applications. Adaptive ignition does not use cylinder pressure and is not restricted to auto (self) ignition.

US 2005/0072402 deals with pre-mixed charge auto (self) ignition, using proxies of cylinder pressure. Adaptive ignition does not use cylinder pressure and is not restricted to the specific application of multi injection/pre-mixed charge, auto ignition.

Winkelhoffer E. et al, MTZ journal September 2001; Optical combustion diagnostik, Issue 62 pages 644-651, concerns itself with analysis in a laboratory setting, not applicable for production engines and real time adjustment of engine parameters. Principal aim is also the detection of causes for knocking, as well as homogeneity of combustion, rather than the very specific (adaptive ignition) task of controlling engine parameters in real time.

Spicher U., MTZ journal April 2007, 3D optical sensors, Issue 68, pages 294-301, deals with a scientific approach to analyse the propagation of flame fronts. Not a method which can be applied to real time optimisation of engine parameters.

SUMMARY OF THE INVENTION

Here, an adaptive approach is superior, where the actual "real time" primary parameters (no proxies) of an engine are used to predict optimum ignition timing (petrol engine) or injection timing (diesel fuel) and fuel dosage, particularly when the elapsed time between the firing of spark plugs or injecting of diesel to start of combustion can be measured in real time.

It's an object of the present invention to provide a method for an engine which runs closer to its peak performance. With an approach according to the present invention, the engine can run closer to its peak performance, considering its unique characteristic and actual environment. Also, being able to run each production engine close to or at optimal performance under a far wider set of environmental parameters, fuel consumption can be further optimized. In addition, the described method can accommodate varying fuel qualities and fuel compositions/mixtures (gasoline, alcohol/ethanol, gas, biofuel, etc.). Depending on the sensor arrangement and algorithm applied, adaptation to fuel changes can take place already after one ignition cycle. In addition, with this invention, the laboratory testing of new engines can be simplified. Stored values from laboratory engines are only used to recover from errors or to provide seed values (start-up, specific operating conditions, etc.), to accelerate the approximation of the optimum values. Hence, the laboratory values do not have to be as accurate and in depth, as with a traditional approach.

The basis of this invention, called "adaptive ignition" (AI), is a method to detect with relatively simple means directly or indirectly the point (or range) at which the fuel mixture ignition phase has completed and combustion commenced. It does this by analysing a sensor signal, where such a signal relates to the combustion activity. The method can either detect a relatively sharp signal point or band during the transition phase from the ignition phase to the combustion phase, or select such a point based on analysis of the signal slope (sharp rise or similar) or signal amplitude (set value, proportional value, or similar). Such point is usually referenced through time or position, where such a reference point is either fixed (for example UD, Upper Deadpoint) or variable.

If now the speed of the engine (time needed for one cycle) is measured, as well as the optimum position is defined (usually UD) where combustion must commence, then the point at which the next spark plug ignition must commence can be calculated. The same applies to a diesel engine, where analogous; the optimum injection point for the fuel can be calculated. If this process starts with an ignition/injection at a reference point (for example: UD) during engine start-up, or while recovering from a sensor error, a linear or adaptive algorithm can be applied to continuously calculate in real time the point at which ignition (or diesel injection) must commence. For the next cycle, in its simplest form, the ignition point is a certain amount of time in advance of a reference point (usually UD). The advancement time is the delay time from start of ignition until the mixture is sufficiently ignited, as measured during the last or a previous cycle(s), whereas the time required to reach the next reference point (UD) is deduced from the engine speed (time needed for one cycle). The strength of such an algorithm lies in high accuracies and generally, the avoidance of proxy sensors (manifold pressure, air temperature, etc.). Further, the engine can run closer to optimum parameters, even in many unforeseen circumstances (wear and tear, unusual climatic environment, varying fuel mixtures and qualities, etc.) or unusual combinations of such circumstances.

Generally, the optimization process aims to complete the ignition phase and start combustion immediately after reaching the upper dead-point (UD) position of the piston, or another reference point. AI does not prescribe which particular reference point must be used, although using UD generally avoids harmful early ignition (shock on bearings), as well as a wasteful late ignition, or harmful very late ignition (overheating of valves, combustion in exhaust). However, it is also possible to advance or delay the timing, such as to optimize secondary parameters like knocking (premature ignition) or pollution (NOx, lambda sensor/catalytic converter, etc.), i.e. a setup where the reference point is variable (result of an algorithm or similar). Thus, while UD is in most cases a natural reference point, it can be substituted with any other point. AI only requires that there is a reference point in order to optimize, but makes no demands as to whether UD or any other fixed or dynamic point is chosen for reference purposes. Similarly, the axis unit (time, angle, distance, etc.) along which the ignition point (transition from ignition to combustion) or a reference point is measured, is not vital for the functioning of AI, as long as it permits a reasonably accurate functioning of the proposed method.

The AI method allows an assessment at which piston position (or point in time) the combustion process actually started (for example: how much early or late in regards to UD measured in time or relative to distance/angle from UD). In a stable situation (no acceleration), it is then possible to correct and reach the optimum position (usually UD) on the next cycle. Any further deviations are then instantly or adaptively/iteratively removed. This is particularly relevant if there are changes to the environment of sudden (load change, etc.) or slow nature (air pressure, humidity, fuel quality, etc.) or changes over longer periods of time (wear and tear, etc.). Generally, even sudden changes can be compensated to be <1% error on the following cycle. Rapid acceleration can cause short time errors in the order of 5%, if only one reference (UD) sensor is used.

A key point of this invention is therefore the direct or indirect detection of the point or range where a mixture in an internal combustion engine transits from an initiation (ignition or injection) phase to the beginning of the combustion phase, where combustion has commenced, or combustion is about to commence. When such a point is compared to an engine reference point in time or space, then predictions can be made as to when to initiate firing of the spark plugs or injecting fuel during a following cycle or cycles. Such predictions can be made in a linear fashion, or using an iterative and/or adaptive algorithm. The aim of such an algorithm is that the point or range, where combustion begins, coincides with a fixed or variable engine reference point.

Further, the invention concerns itself with the means to detect, directly or indirectly, the point or band where a mixture in an internal combustion engine is about to commence combustion, or combustion has commenced and combines such detection with a reference point or points, in such a way as to optimise the timing of firing spark plugs or beginning of fuel injection. Such optimization can occur in the immediate next cycle, or subsequent cycles.

In a further variation, the invention may also contain means to directly or indirectly detect the intensity of the combustion process and combines such detection with means to optimize fuel quantities.

Compared to other recent inventions in this field, AI differentiates itself as follows:

- DE 103 30 819 B4 deals with a method to obtain a homogenous combustion and minimising the amount of particles by measuring light emitted at very specific wavelengths.
- DE 103 07 367 A 1 deals with a method to control engines fuelled with gas, where the cylinder pressure is measured and analysed. The principal aim is to control the fuel (gas) quantity.

BRIEF DESCRIPTION OF THE DRAWINGS

The present invention is specified with reference to the accompanying drawings, but is not limited to the shown embodiments.

DETAILED DESCRIPTION OF THE PREFERRED EMBODIMENTS

Figure 1:
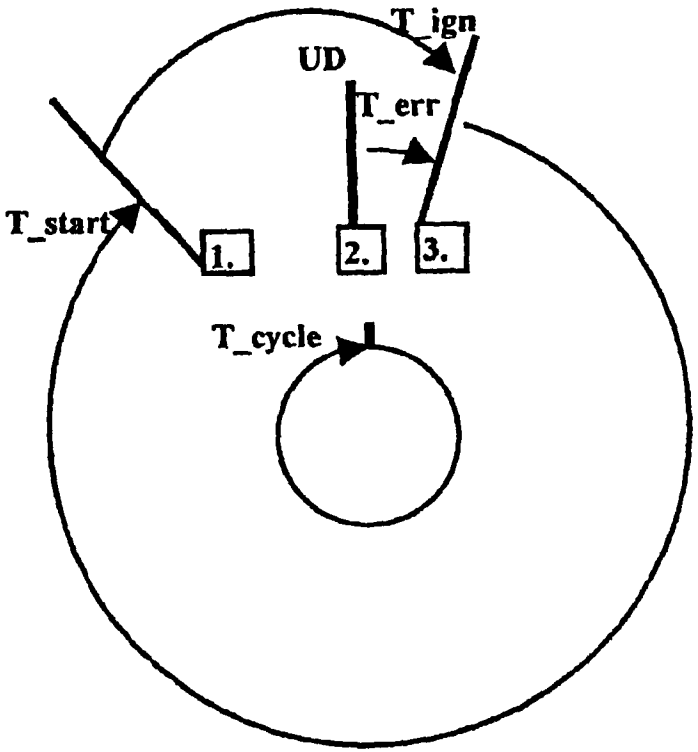
FIG. 1 shows a preferred operation of the present invention

FIG. 1 shows the preferred operation of the described method:

At the start point (1.), the spark plugs are fired or diesel is injected. Combustion is about to commence or has commenced when reaching point 3. This point may or may not be after a reference position (usually UD or T_zero) labelled 2. It is now possible to measure or deduce the following elapsed times: T_cycle, the time required for one cycle (engine speed), T_error, the delta of combustion commencing before or after a reference point (UD) and T_ign, the time required after firing spark plugs or injecting diesel until combustion is established. Using these measured or deduced values, T_start, the time at which the next ignition (petrol engine) or injection (diesel engine) is to be initiated (starting from the reference point, usually UD), can be calculated in a continuous fashion.

In theory, $T_start = T_cycle - T_ign$

Where T_zero (start point) is a reference point (UD, etc.)

In practice, it may be beneficial to measure the deviation (T_err) from a reference point (usually UD) and apply an adaptive, iterative algorithm, to compensate for T_err in steps.

$T_start = T_cycle - (Tign + T_err)$

A cycle usually refers to a power stroke in a four stroke or two stroke engine. The major difference in how AI operates compared to conventional ignitions is that T_ign and/or T_err can be measured "in situ", in real time during or after each cycle. With AI there is generally no need to estimate T_ign using stored values from a test engine in combination with proxy sensor values.

For practical purposes, an algorithm may be applied where T_err/2 or similar is applied, to avoid sudden jumps and a positive delta is added to force ignition slightly after UD. There may also be a plausibility check to confirm that the calculated parameters are within expected limits. Should the firing not have taken place when reaching UD, the firing/injection should be immediately initiated at UD (generally this applies during the start-up period, when reliable T_ign and T_cycle data are not yet available). There may also be scenarios where T_ign is not measured on every cycle, requiring a modified algorithm. Since AI allows much faster measurements than conventional ignition control systems, where sensors only react with considerable delay, not every cylinder must be monitored with an AI sensor, although measuring each cylinder will further improve results and equalize differences across cylinders. To further improve the reliability, an arrangement with several sensors can be used to provide redundancy, i.e. the values from sensors (in one cylinder) can be used instead of a failed sensor (in another cylinder). With such measures, the already excellent reliability of AI sensors can be even further improved. These practical considerations have no impact on the underlying functioning of AI. The illustrations of practical cases only serve to strengthen the algorithm, where such algorithm may vary considerably, depending on the actual application.

When starting an engine, cycle time compared to ignition time is low, hence firing could take place at a reference point (usually UD) and the linear or adaptive algorithm only needs to start when stable values for ignition time and cycle time are available. This may lead to late ignition for the first few cycles, but since the error is generally <5%, this has no further consequences, particularly when considering that engine start-up is usually not on full load and of very short duration. Firing on UD during start-up is a simple way to start an engine, but there are of course also other algorithms feasible (amongst others: using of seed values, etc.).

In short, this invention concerns itself with a means to detect the transition between the ignition phase and the combustion phase of an internal combustion engine and uses this means to predict when the next firing of spark plugs (or injection of diesel) should take place. To further improve the invention, an adaptive/iterative algorithm can be applied. For an ignition control system, one primary sensor is required to detect the threshold from ignition to combustion, assisted by a simple secondary sensor (UD position or similar reference point) or other means for referencing purposes. Complex proxy sensors like air flow, air temperature, manifold pressure or throttle position are generally not needed.

Apart from ignition (injection) timing control, AI can additionally, or separately, be used for fuel quantity control or optimisation. With most AI sensors, the intensity of the combustion process can also be measured directly or indirectly to provide feedback as to how changes in fuel quantities relate to corresponding changes in engine performance. Unlike the ignition timing measurement, measurements of the combustion intensity does not generally allow an absolute or direct assessment whether a parameter was met or missed by how much. Instead, for fuel quantities, only relative measurements can generally be made to provide direct or indirect feedback in regards to the relation to the impact of fuel quantity change on the combustion process. Hence, it may take several cycles as well as a deliberate, periodic oscillation or other variations, to find the optimum fuel quantity.

To also control fuel injection (fuel quantity) with the AI method, an iterative process is proposed, although other processes may also be feasible. One example of such a process is the injection/using of an initial (seed) quantity of fuel. Subsequently, the quantity is altered to iteratively find the optimum fuel quantity by comparing combustion intensities with different fuel quantities. An example of such an algorithm is the injection of an initial fuel quantity, where this quantity is then slightly increased during the next cycle or over a period of time and a combustion intensity comparison is made to see whether the additional quantity has let to an improvement of the combustion. If yes, the quantity is further increased. If not, the fuel quantity is slightly decreased, to the point where the fuel reduction leads to a reduction of the combustion activity. At this point, the quantity is increased again and the cycle starts again. With this approach, the fuel quantity oscillates around the optimum for a given air supply (throttle position), being at all times close to the optimum. Again, the optimum position can be found by essentially needing only one sensor. For this purpose, the signal from the AI sensor needs further analysis, where the signal amplitude, the signal curve and/or the integral of the signal amplitude over part of the combustion cycle is evaluated. For fuel injection quantity optimisation, one additional sensor may be required to detect load changes, such as a throttle position detector, manifold pressure or airflow sensor. However, this additional sensor does not demand high accuracy. Since only the approximate magnitude of load changes must be detected, such additional sensor can be of a low cost type. The load change could then be used to approximate the step change required for the fuel quantity. Optimisation of the fuel quantity thereafter could occur iteratively, using for example the adaptive/oscillation algorithm. For fuel injection purposes, a simple engine temperature sensor may also be beneficial, to differentiate a warm start from a cold start, when turning on an engine.

In short, this invention (AI) can also be used to optimise the fuel quantity which is to be injected/measured into an engine. A further refinement is the application of an iterative/oscillation approach, to find the optimum fuel quantity.

Primary sensors used for this purpose (AI) are all sensors which provide direct or indirect clues as to how well and fast combustion takes place during a combustion cycle, or how well combustion took place, when measuring at the end of a cycle or after completion of a cycle. Particularly interesting are optical sensors and torque sensors. It is also possible to implicitly assess the combustion parameters through pressure sensors or timing measurements as well as acoustic sensors. Common to all of these sensors is that they must produce a distinct signal (sharp rise, certain amplitude, or similar) during or at the end of the ignition phase or when transiting into the combustion phase.

Figure 2:
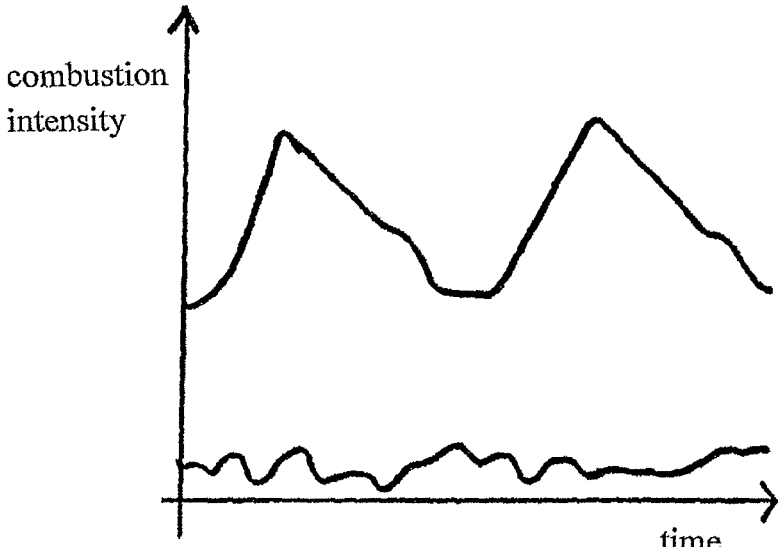
FIG. 2 shows a measurement of a load condition measured by a piezo sensor (CH1: Sensor; CH2: ignition, primary coil)

In some environments, the primary sensor can be a torque sensor. Torque would ideally be measured between piston and the crank connection. However, this may not always be practical and an arrangement where torque is measured in the engine mounting or other suitable mountings may suffice, provided vibration levels do not mask out the main signal. FIG. 2 shows the signal of a piezo sensor installed in the engine mounting. To measure torque in the engine mounting, piezo sensors are particularly adequate. In a similar arrangement, such piezos or other suitable sensors can be used to acoustically measure the progress of a combustion process. Such acoustic sensor must be mounted in a manner to receive mostly the combustion noise, (reasonable S/N factor). Ideal locations for acoustic sensors are the spark plugs or the cylinder head. Again, this is only practical where vibration noise does not mask out the main signal.

Figure 4:
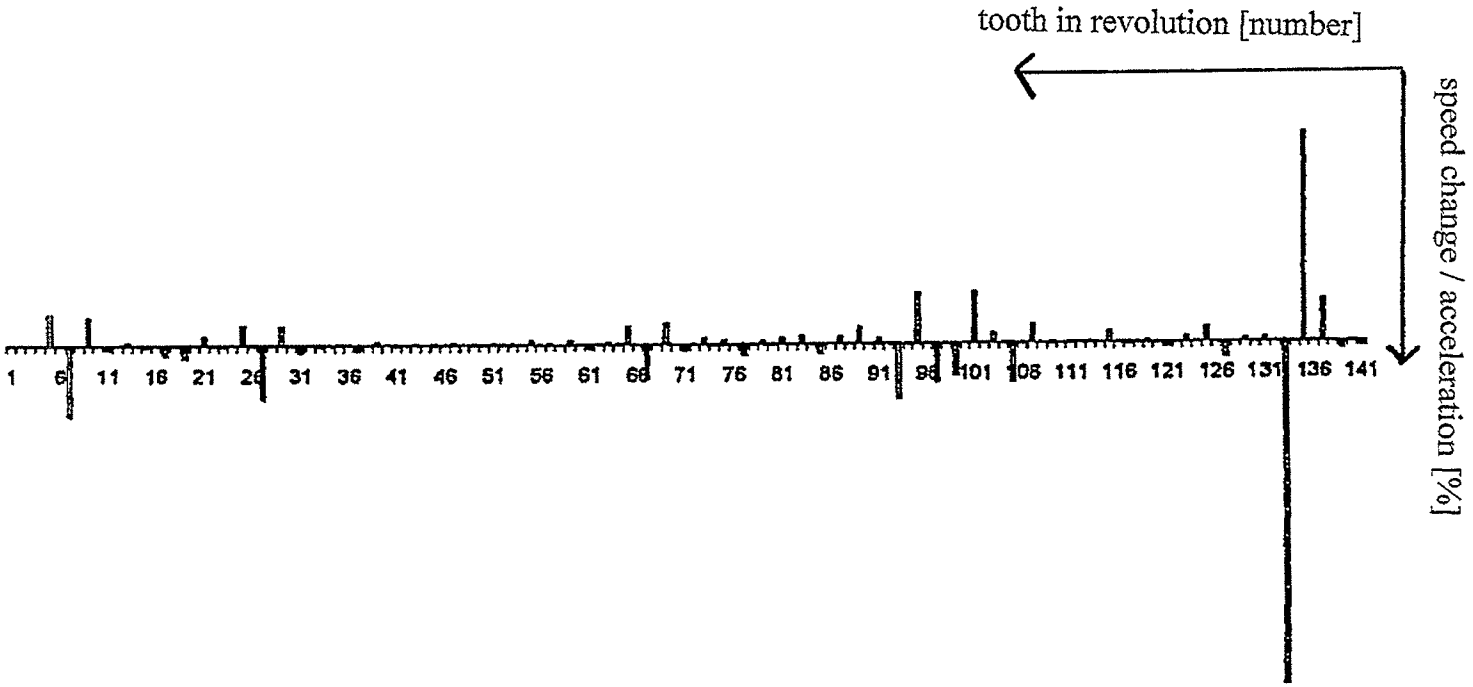
FIG. 4 shows a diagram of a measurement of crank shaft speed/acceleration during one revolution (Example: early ignition with oscillations)

A much simpler approach is to use a crank shaft sensor to measure the crank shaft speed at small intervals. Correct ignition timing will lead to an acceleration after the UD, whereas advance timing will lead to a decrease. See FIG. 4 for the results of such a measurement. However, this approach is subject to distortions due to oscillations and influences from the drive shaft/load and may not be suitable for all applications.

Figure 3:
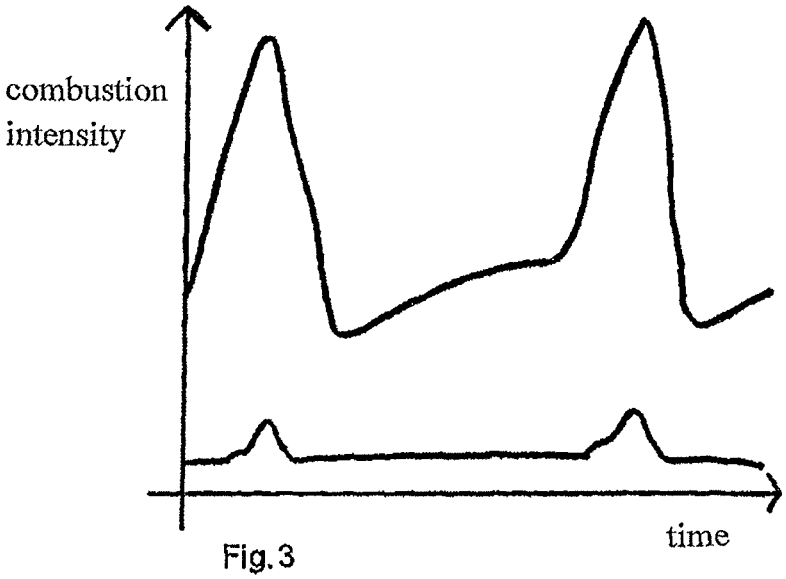
FIG. 3 shows a measurement of an idle/no load condition measured by a optical sensor (CH1: Sensor; CH2: ignition, primary coil)
Figure 5:
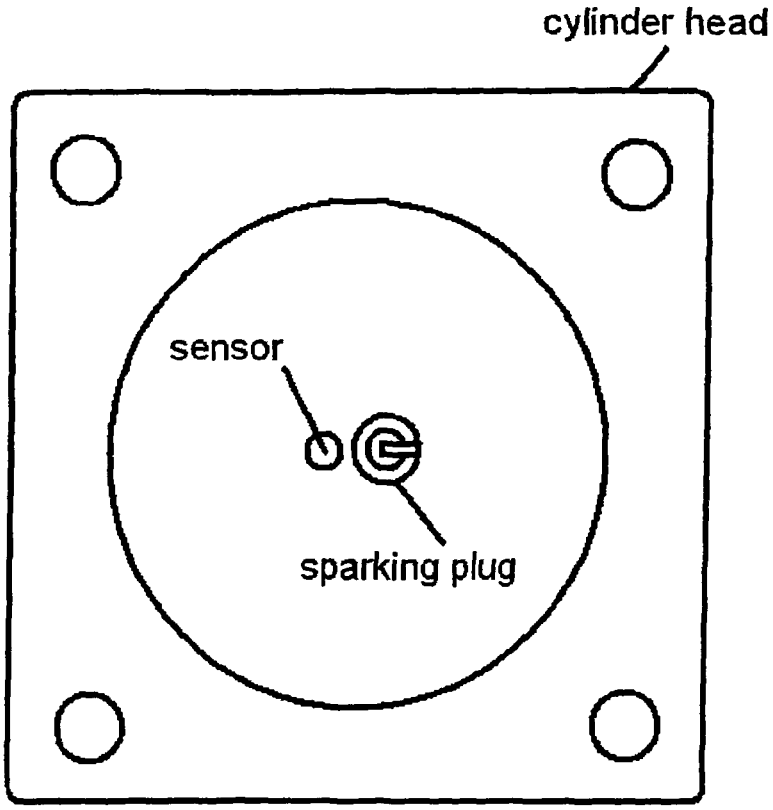
FIG. 5 depicts an application of an optical sensor for a 2 stroke example where the glass surface remains clean despite oil deposits on cylinder head

Very accurate results can be achieved using an optical sensor. FIG. 3 shows the signal of such an optical sensor. For practical purposes, a high temperature resistant optical fibre (quartz glass or similar) could be used as a "conductor" (glass rod of 1-3 mm diameter for example) and fixed in the cylinder head or integrated into a spark plug (or the injection valve in a diesel application). This "conductor" should protrude into the cylinder/cylinder head space sufficiently (generally in the order of 1-2 cm) to allow the continuous burning off of combustion residues (4 stroke/diesel) or oil (2 stroke environment). An optical sensor or "conductor" should also protrude sufficiently to be mostly "blind" to the light generated by a spark plug. See FIG. 5 for an example. Outside the cylinder head, at a sufficient distance to avoid overheating (generally in the order of 1-2 cm), an optical receiver (example: full spectrum PIN Diode or similar) can be installed. Such an arrangement produces an electrical signal when the combustion process starts. The initial slope of this signal is quite steep, allowing a fairly accurate measurement of the combustion point/band. The amplitude and/or the integral of amplitude over time during the combustion cycle allows for a simple approximation of the combustion energy. This in turn can be used in an adaptive algorithm to calculate the optimum fuel quantity.

The above description of an optical sensor is only one of many possible options for optical or other sensors. Depending on the environment, different arrangements to place sensors and accessories (for example a glass rod) are feasible, where a suitable sensor is placed wherever a reliable signal can be obtained. Examples are items connected to the engine (engine mounting, etc.), engine block, cylinder head, parts which are added to the engine (spark plugs, injection valves, pre-heater, etc.).

Some of the benefits of such an arrangement are a reduction in production cost, higher reliability and reduced engine testing in a laboratory for new engines, as well as lower fuel consumption for production engines. The adaptive nature of this method also allows the use of bio-fuels and mixtures thereof (fuel/ethanol, bio-diesel, gas, etc). Compared to conventional sensors, there is also a reduced time lag between detecting input changes (load, environment, fuel, etc.) and being able to adjust ignition timing as well as fuel quantity. A reduction of production costs is possible since fewer (proxy) sensors are required, which also leads to a corresponding saving in interface electronics. Fewer sensors also lead to higher reliability, as measured in mean time between failures. The cost of the AI sensor(s) are marginal (low cost sensors).

This invention (AI) is equally applicable for the design of new engines, as well as the retrofit market. All or some of the AI sensors can be permanently connected to the engine or engine parts. Alternatively, some of the sensors can be placed in consumable items (such as spark plugs) to be replaced at periodic intervals (generating ongoing revenue).

An external factor on the engine is, for example the environment, internal factors are, for example engine status or wear and tear and fuel factors are, for example compositions and quality, mixtures of gasoline and ethanol, bio-fuels or similar.

The invention claimed is:

1. A method to operate an internal combustion engine, comprising:

a step of determining a point in time at which ignition or injection of fuel takes place as a start point, and a step of measurement in a cylinder of the point in time which marks the beginning of the combustion phase in the cylinder as a combustion point and a step of measuring a time needed for one cycle of the engine as an engine speed, wherein at least one sensor is or are used to measure combustion intensity as an optical parameter in order to determine the combustion point, with the combustion point being defined as the point where a sharp rise in combustion activity is detected;

wherein the at least one sensor is connected with the engine, the start point, the combustion point and the engine speed are determined during operation of the internal combustion engine, and the point in time T_start at which a next ignition or fuel injection is to commence is calculated during operation of the internal combustion engine after start up based on the engine speed T_cycle and on a time delay T_ign between the start point and the combustion point and based on a time deviation T_err between the combustion point and a pre-defined reference point by applying at least one of the equations T_start=T_cycle−(T_ign+T_err) and T_start=T_cycle−(T_ign+T_err/2), without using stored values from a test engine for determining the time delay between the start point and the combustion point.

2. The method to operate an internal combustion engine according to claim 1, further comprising comparing the combustion point relative to a reference point, such that in a following cycle or following cycles, this comparison can be used by itself or in combination with other parameters to determine the point where the spark plug or plugs need to be fired in the case of an extraneous igniting engine or fuel injection is to commence in the case of a self igniting engine.

3. The method to operate an internal combustion engine according to claim 2, further comprising measuring directly or indirectly the intensity of the combustion in the combustion chamber to allow the comparisons of the effects of changes in fuel quantities to the effect on combustion intensity.

4. The method to operate an internal combustion engine according to claim 2, wherein the reference point is the position or time where the piston is at the upper-dead-point (UD).

5. The method to operate an internal combustion engine according to claim 2, wherein the reference point is offset from UD, is a certain time ahead, or is after UD.

6. The method to operate an internal combustion engine according to claim 2, wherein the reference point is dynamically computed.

7. The method to operate an internal combustion engine according to claim 1, wherein an iterative and/or adaptive algorithm is applied to obtain optimum values regarding ignition timing, injection timing or/and optimization of the fuel quantity in the combustion chamber.

8. The method to operate an internal combustion engine according to claim 1, further comprising measuring at least one discrete point per revolution, cycle or parts of a cycle, to determine a piston position or crank shaft angle or time elapsed.

9. The method to operate an internal combustion engine according to claim 1, further comprising measuring the time required for one revolution, one complete cycle, or parts of a cycle, as well as the time required from ignition/injection until the combustion point has been reached.

10. The method to operate an internal combustion engine according to claim 1 wherein varying combustion points and/or changes in the combustion speed are directly or indirectly determined.

11. The method to operate an internal combustion engine according to claim 10, wherein changes in the combustion speed by external factors or internal factors are recognized.

12. The method to operate an internal combustion engine according to claim 10 wherein changes in the combustion speed are used in an algorithm, such that, on average, the combustion point and the reference coincide.

13. A combustion engine comprising means to measure, during operation of the internal combustion engine, a point in time at which ignition or injection of fuel takes place as a start point and the point in time which marks the beginning of the combustion phase in the cylinder as a combustion point and a time needed for one cycle of the engine as an engine speed, with at least one optical sensor which is or are used to measure combustion intensity as an optical parameter in order to determine the combustion point, with the combustion point being defined as the point where a sharp rise in combustion activity is detected;

wherein such at least one sensor is connected with the engine, and means configured to calculate, during operation of the internal combustion engine after start up, the point in time T_start at which a next ignition or fuel injection is to commence based on the engine speed T_cycle and on a time delay T_ign between the start point and the combustion point and based on a time deviation T_err between the combustion point and the time at which a piston of the engine is at a pre-determined reference point by applying at least one of the equations T_start=T_cycle−(T_ign+T_err) and T_start=T_cycle−(T_ign+T_err/2), without using stored values from a test engine for determining the time delay between the start point and the combustion point.

14. The combustion engine according to claim 13, wherein one sensor is included for several or all cylinders, or one sensor for each cylinder, or multiple sensors per cylinder.

15. The combustion engine according to claim 13, further comprising means to directly or indirectly measure the intensity of the combustion process for varying quantities of fuel and means to use such measurement to optimize the fuel quantity in a combustion chamber.

16. The combustion engine according to claim 13 wherein the sensor or components thereof are partly or completely integrated into a part which is detachable from the engine.

17. The combustion engine according to claim 13, wherein the sensor or components thereof are part of the cylinder head or the engine block, or other engine parts.

18. The combustion engine according to claim 13, wherein the sensor arrangement contains an optical fibre or other means with optical properties, entering into or protruding into the combustion chamber, or with similar optical access to the cylinder, cylinder head or combustion chamber.

19. The combustion engine according to claim 18, wherein the optical fibre is arranged in a manner to minimize the amount of light received by firing a spark plug.

20. The combustion engine according to claim 13, wherein an ignition phase nears its end within the time period or less prior of the transition point from the ignition phase to the combustion phase, and an upper dead point of a corresponding piston.

21. The combustion engine according to claim 13, wherein an ignition phase nears its end within a time-period which takes 5% or less of a working cycle.

* * * * *

UNITED STATES PATENT AND TRADEMARK OFFICE

CERTIFICATE OF CORRECTION

PATENT NO. : 8,718,900 B2
APPLICATION NO. : 12/598545
DATED : May 6, 2014
INVENTOR(S) : André Schoen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1220 days.

Signed and Sealed this
Twenty-ninth Day of September, 2015

Michelle K. Lee

Michelle K. Lee
*Director of the United States Patent and Trademark Office*